US006709056B2

(12) United States Patent
Bock

(10) Patent No.: US 6,709,056 B2
(45) Date of Patent: Mar. 23, 2004

(54) PRELOADED SPRING ARRANGEMENT, IN PARTICULAR FOR SPRING LOADING OFFICE CHAIR SYNCHRONIZING MECHANISMS

(75) Inventor: Hermann Bock, Pyrbaum (DE)

(73) Assignee: Bock-1 GmbH & Co., Postbauer-Heng (DE)

( * ) Notice: Subject to any disclaimer, the term of this patent is extended or adjusted under 35 U.S.C. 154(b) by 0 days.

(21) Appl. No.: 10/147,856

(22) Filed: May 20, 2002

(65) Prior Publication Data

US 2002/0171277 A1 Nov. 21, 2002

(30) Foreign Application Priority Data

May 18, 2001 (DE) ..... 101 26 001

(51) Int. Cl.[7] ..... A47C 1/024

(52) U.S. Cl. ..... 297/300.4; 297/300.5; 297/301.4; 297/300.1; 267/155

(58) Field of Search ..... 297/300.1, 300.5, 297/300.4, 319, 320, 321, 316, 300.8, 300.7, 300.6, 303.3, 303.4, 303.5, 301.4; 267/155, 160

(56) References Cited

U.S. PATENT DOCUMENTS 3,339,973 A * 9/1967 Doerner ..... 297/300.4
4,588,175 A 5/1986 Martin et al.
4,848,837 A * 7/1989 Volkle ..... 297/300.1
4,923,181 A 5/1990 Streett
5,029,940 A * 7/1991 Golynsky et al. ..... 297/300.4
5,224,758 A * 7/1993 Takamatsu et al. ..... 297/300.5
5,238,294 A * 8/1993 Ishi et al. ..... 297/300.5
5,354,120 A * 10/1994 Volkle ..... 297/300.1
5,540,481 A * 7/1996 Roossien et al. ..... 297/300.4
5,810,439 A * 9/1998 Roslund, Jr. ..... 297/300.4
6,425,633 B1 * 7/2002 Wilkerson et al. ..... 297/300.2
6,523,896 B1 * 2/2003 Uhlenbrock ..... 297/300.4

FOREIGN PATENT DOCUMENTS

DE 44 11 471 A1 10/1995
DE 199 22 446 A1 11/2000

* cited by examiner

*Primary Examiner*—Peter M. Cuomo
*Assistant Examiner*—Erika Garrett
(74) *Attorney, Agent, or Firm*—Browdy and Neimark

(57) ABSTRACT

A preloaded spring arrangement, in particular for spring loading office chair synchronizing mechanisms, comprises a pair of leg springs, which are coaxially positioned on a common axis, each having a supporting leg and a positioning leg; and a preferably manually operated adjusting unit of the type of an eccentric, which the two positioning legs are coupled with and by which they are displaceable for adjustment of the preload of the spring arrangement; wherein, for stepwise locked spring load adjustment, the adjusting unit of the type of an eccentric comprises a pair of eccentric cams sitting axially side by side, the cam surfaces of which, related to the direction of rotation of the eccentric arrangement, successively comprise plane locking sections, eccentric cam control sections and holding sections that are concentric of the axis of rotation of the eccentric arrangement; and wherein the respective locking, cam control and holding sections of the two eccentric cams are offset in the direction of rotation of the eccentric arrangement.

7 Claims, 6 Drawing Sheets

PRELOADED SPRING ARRANGEMENT, IN PARTICULAR FOR SPRING LOADING OFFICE CHAIR SYNCHRONIZING MECHANISMS

BACKGROUND OF THE INVENTION

1. Field of the Invention

The invention relates to a preloaded spring arrangement, in particular for spring loading office chair synchronizing mechanisms, and to a synchronizing mechanism that comprises such a spring arrangement.

2. Background Art

DE 199 22 446 A1 teaches a synchronizing mechanism for correlated seat/backrest motion of an office chair, in which a spring arrangement acts on the synchronizing mechanism in the direction of its non-tilted normal position. This spring arrangement comprises a pair of leg springs, which are located coaxially on a common axis, each having a supporting leg and a positioning leg. The positioning legs support themselves on an adjusting mechanism for modification of the preload of the leg springs. The adjusting mechanism is put into practice by a wedge-type sliding transmission which is adjustable crosswise of the longitudinal axis of the synchronizing mechanism and the driving wedge of which is adjustable by way of a spindle drive from the side of the synchronizing mechanism. The respectively associated positioning leg of the leg spring supports itself on this driving wedge.

Problems posed by the prior art spring load adjustment reside in the comparatively complicated construction of the adjusting mechanism on the one hand, which comprises a spindle drive and two wedges resting one upon the other for translation of the transverse displacement of the driving wedge occasioned by the spindle drive into a longitudinal displacement of the driven wedge. Since the supporting force of the positioning legs of the leg springs acts, via the driven wedge, directly on the contact surface between the two wedges, strong friction, in particular static friction, is found within the adjusting mechanism in particular in the case of high preloads. This may lead to the adjusting mechanism being comparatively hard to operate. Furthermore, upon preload regulation, both positioning legs are shifted simultaneously and by the same displacement so that sensitive regulation does not go without problems. Moreover, the restoring force of both leg springs must be countered, which implies an increase in energy requirements.

SUMMARY OF THE INVENTION

It is an object of the invention to embody a preloaded spring arrangement such that constructional simplicity is accompanied with the possibility of spring load regulation with great sensitivity and a decrease in energy requirements.

This object is attained by an adjusting unit of the type of an eccentric, which the two positioning legs are coupled with, and by which they are displaceable for regulation of the preload of the spring arrangement. For stepwise locked spring-load regulation, the eccentric adjusting unit comprises a pair of cams sitting axially side by side, the cam surfaces of which, related to the direction of rotation of the eccentric arrangement, successively exhibit plane locking sections, cam control sections and holding sections that are concentric of the axis of rotation of the eccentric arrangement. Finally, the respective locking, cam control and holding sections of the two eccentric cams are offset from one another in the direction of rotation of the eccentric arrangement in such a way that while one of the two positioning legs passes a cam control section that occasions displacement and thus load adjustment, the second positioning leg runs along the concentric holding section without experiencing any adjustment. Once the cam control section has been passed, the corresponding positioning leg applies on the locking section, which leads to a defined position of rotation of the adjusting unit. The other positioning leg has reached the beginning of the holding section so that, upon further rotation of the eccentric unit, it applies on the concentric holding section, occasioning no load counter to the adjusting rotation.

The construction according to the invention and in particular the eccentric adjusting unit, which comprises a pair of eccentric cams with functional sections that are displaced one relative to the other, help obtain actuation of the spring arrangement in fine steps of locking and with comparative ease during load adjustment. The construction according to the invention excels by extreme simplicity, there being only the need of joining a rotatable element to a turning handle for instance by way of a shaft.

Details of the invention will become apparent from the ensuing description of an exemplary embodiment taken in conjunction with the drawings.

DESCRIPTION OF THE PREFERRED EMBODIMENT

Figure 1:
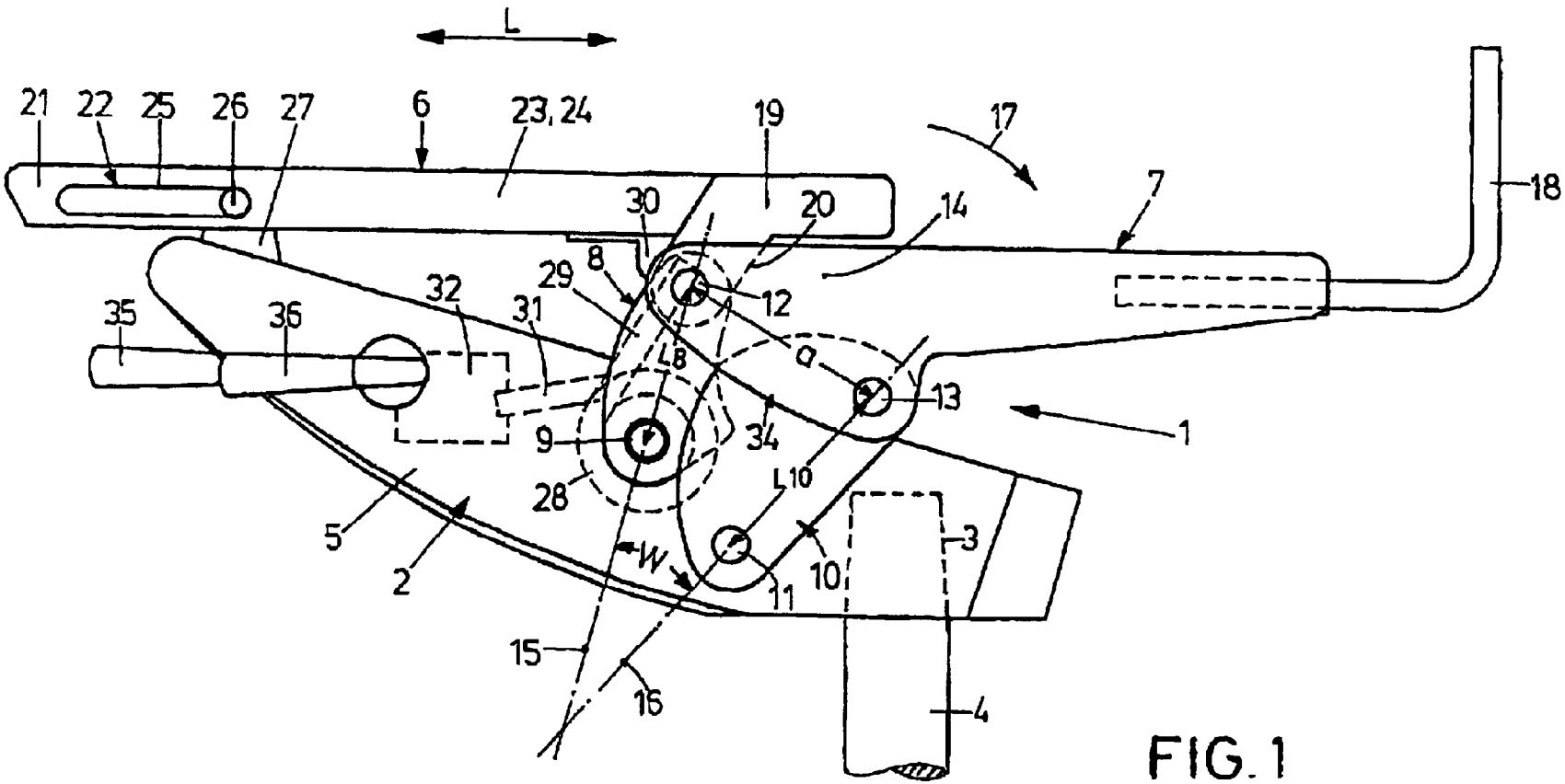
FIG. 1 is a diagrammatic lateral view of the synchronizing mechanism in a normal position.

Preceding the detailed description of the spring arrangement, the fundamental structure of the synchronizing mechanism, which is denoted by 1 in its entirety, will be explained in conjunction with FIGS. 1 and 3. It comprises a base carrier 2 that is placed on the upper end of a chair column 4 by means of a cone receptacle 3. Various constructional elements of the synchronizing mechanism 1 are outside and above the lateral cheeks 5 that run parallel to the longitudinal direction L of the chair. The core pieces thereof are a substantially frame-type seat carrier 6 and a backrest carrier 7 which is forked seen in a plan view. Mounted on the seat carrier 6 is the seat (not shown) with an upholstered seat panel. By way of an elbowed cross arm 18, the backrest carrier 7 holds a backrest (not shown) which is vertically adjustable in today's office chairs.

Figure 3:
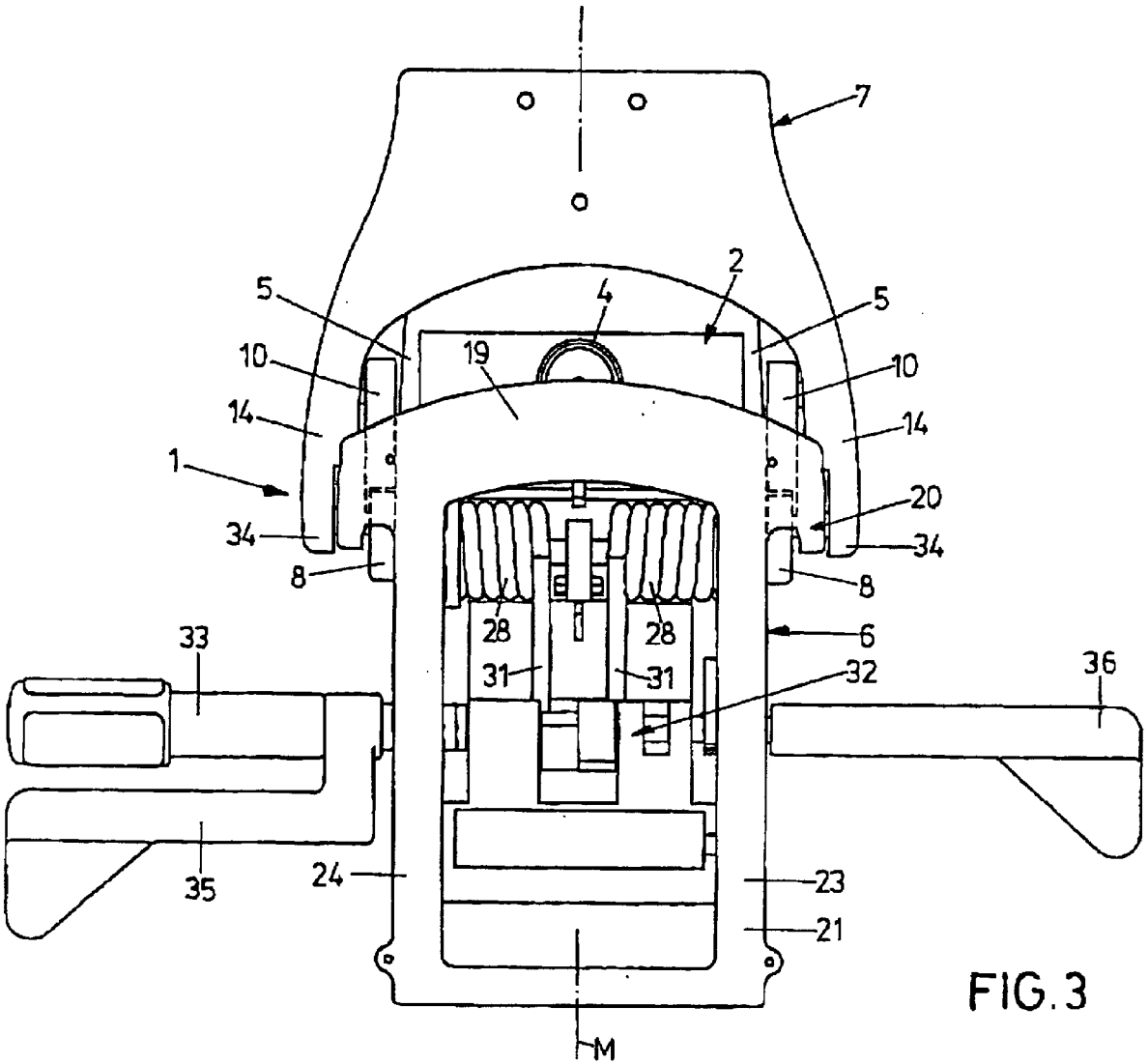
FIG. 3 is a diagrammatic plan view of the synchronizing mechanism according to FIG. 2.

In terms of kinematics, the entire synchronizing mechanism 1 is designed in mirror symmetry to the longitudinal center plane M as seen in particular in FIG. 3. In this regard, the ensuing description regularly proceeds from constructional elements that are available bilaterally in pairs.

The backrest carrier 7 is articulated to the base carrier 2 by way of a cam arrangement. This arrangement comprises a first cam 8 which is articulated approximately centrally to a pivot bearing 9 on the base carrier 2. A second cam 10 is mounted between the front cam 8 and the cone receptacle 3 on a pivot bearing 11 on the base carrier 2. The free ends of the two cams 8, 10 are coupled with the backrest carrier 7 by way of joints 12, 13. The two pivot bearings 9, 11 and the joints 12, 13 define a four-bar chain in which the backrest carrier 7 itself forms the coupling by its respective forked leg 14. In the normal position of the backrest carrier 7 seen in FIG. 1, the front cam 8 is positioned approximately vertically upwards, while the rear cam 10 inclines backwards. In this case, the longitudinal axes 15, 16 of the cams 8, 10 that pass through the points of articulation make an acute angle W (FIG. 1) slightly greater than 30° that opens upwards toward the seat carrier 6. The ratio that the length of the front cam 8 bears to the length of the rear cam 10 is approximately 2.5:3. Owing to this design and the arrangement of the four-bar chain, the backrest carrier 7 makes a combined rotary pivoting motion downward to the rear, which is roughly outlined by the arrow 17 in FIG. 1.

The seat carrier 6 is coupled with the backrest carrier 7 before its rear end 19, via a bearing lug 20, to the axis that forms the front joint 12 as seen in FIG. 1, its rear end thus being linked. Consequently, the joint between the seat carrier 6 and the backrest carrier 7 is integrated into the front joint 12 between the cam 8 and the backrest carrier 7. At its front end 21—which is on the left in FIG. 1—the seat carrier 6 is linked to the base carrier 2 by a turning and sliding joint which is denoted by 22 in its entirety. On the one hand it is comprised of an oblong-hole-type connecting member 25 which is incorporated in the longitudinal legs 23, 24 that are located on both sides; on the other hand a bearing journal 26 engages from inside with the connecting member 25. The bearing journal 26 is molded on a prolongation 27 of the base carrier 2, standing out therefrom at right angles to the longitudinal center plane M and reaching into the connecting member 25.

The synchronizing mechanism 1 is biased by a spring arrangement F counter to the direction of the arrow 17—i.e. towards the normal position of the synchronizing mechanism 1. This spring arrangement F is available in the form of two leg springs 28 (FIG. 3) which are in alignment in the cross direction and positioned around the axis 21 that constitutes the pivot bearing 9 of the front cam 8. The upward leg 29 supports itself on a projection 30 on the seat carrier 6, whereas the second forward leg 31 supports itself on an adjusting mechanism 32 in the base carrier 2. The leg springs 20 exercise spring-loading counter to the backward pivoting motion of the backrest which is variable through the adjusting mechanism 32 by actuation of a turning lever 33.

Figure 2:
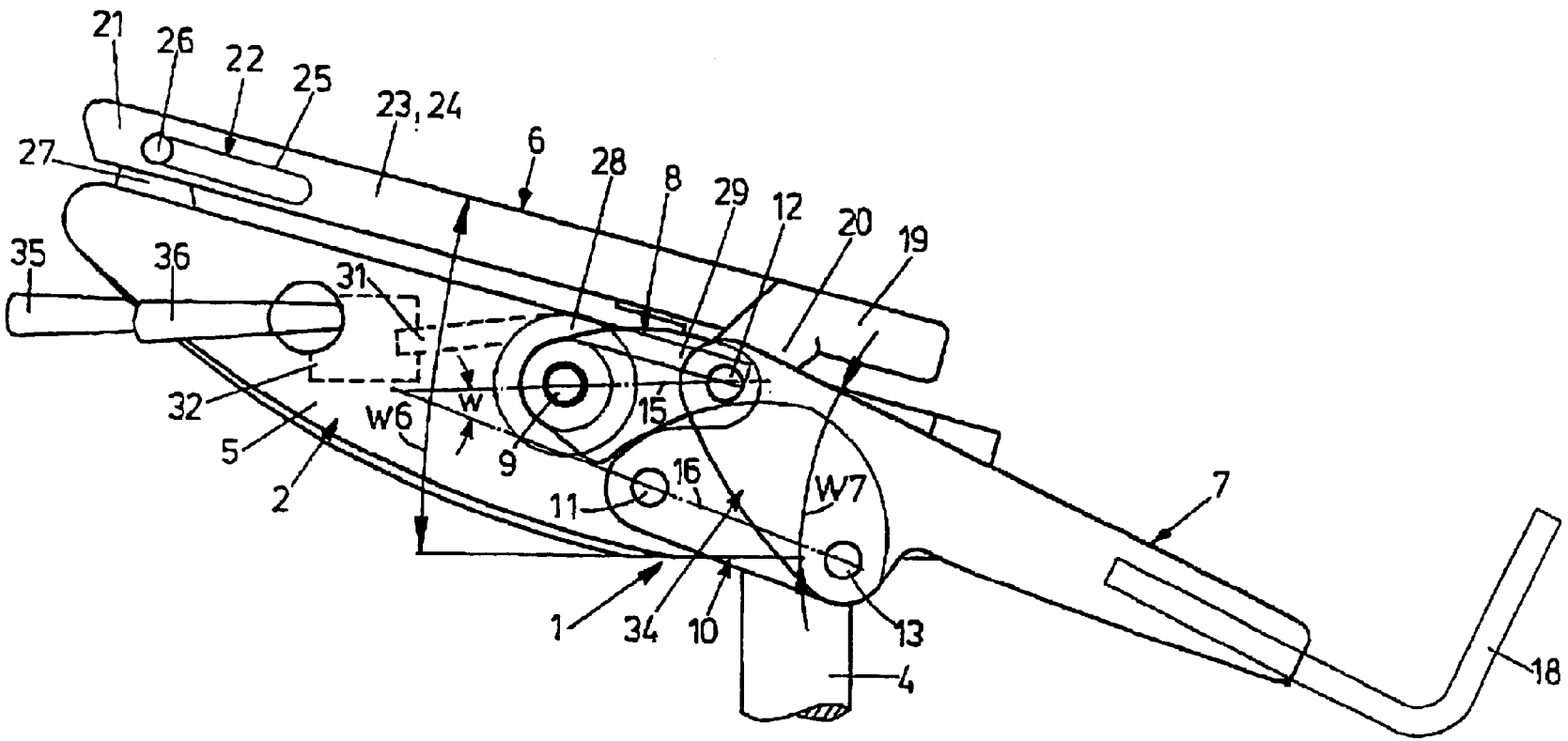
FIG. 2 is a lateral view by analogy to FIG. 1 in a backwards tilted position of the synchronizing mechanism.

As can be seen from a comparison of FIGS. 1 and 2, the backrest carrier 7, upon actuation of the backrest rearwards, makes the pivoting motion downward to the rear that is roughly outlined by the arrow 17, with the rear cam 10 and the front cam 8 of the four-bar chain also tilting further backwards. In the case of a maximal pivoting angle of the backrest carrier 7, the angle W between the longitudinal axes 15, 16 of the two cams 8, 10 is approximately 20° (FIG. 2). The four-bar chain folds up, as it were, compared to the spread initial position according to FIG. 1 so that this quite compact arrangement becomes even smaller.

Another contribution to the compact arrangement resides in that the distance a of the two joints 12, 13 which are located between the backrest carrier 7 and the cams 8 and 10, respectively, is approximately equal to the length L10 of the rear cam 10 and, in the ratio specified above, greater than the length L8 of the front cam 8.

By means of the mentioned pivoting motion of the four-bar chain with the backrest carrier 7, the seat carrier 6 is pivoted downwards to the rear as well as displaced horizontally to the rear in the vicinity of the turning and sliding joint 22. As a result, there is no relevant lift of the front end 21 of the seat panel, which helps avoid constrictions or pressure on the lower side of the thighs.

The synchronizing mechanism 1 is designed in such a way that, in the final position of backward tilt seen in FIG. 2, the backrest carrier 7 passes through a pivoting angle W7 of approximately 26°, while the pivoting angle W6 of the seat carrier 6 is approximately 15°. The pivoting angle W7 to W6 ratio is approximately 1.8:1 in the position of maximal tilt.

As seen in FIGS. 1 and 3, the cams 8, 10, which are attached externally to the seat carrier 6, have an approximately reniform widened sheet configuration, there being overlap of the cams 8, 10 in any position of pivot between the two positions according to FIGS. 1 and 2 and in combination with the bearing cheeks 34 of the forked backrest carrier 7 that apply externally on the cams 8, 10, so that there is no possibility of reach-through between the cams 8, 10, base carrier 2 and backrest carrier 7. In this way, the fingers of someone who sits on the chair are efficiently protected against getting stuck when the synchronizing mechanism is pivoted.

In a manner not shown in detail, the synchronizing mechanism 1 is lockable in various positions between the normal position (FIG. 1) and the position of maximal backward tilt (FIG. 2). The figures do not explicitly show the corresponding locking mechanism and there is no need of detailed specification because it is prior art. Attention is only drawn to the fact that locking takes place by means of another operating lever 35 on the side of the turning lever 33. The operating lever 36 on the other side serves for releasing the vertical adjustment of the chair column 4.

Figure 4:
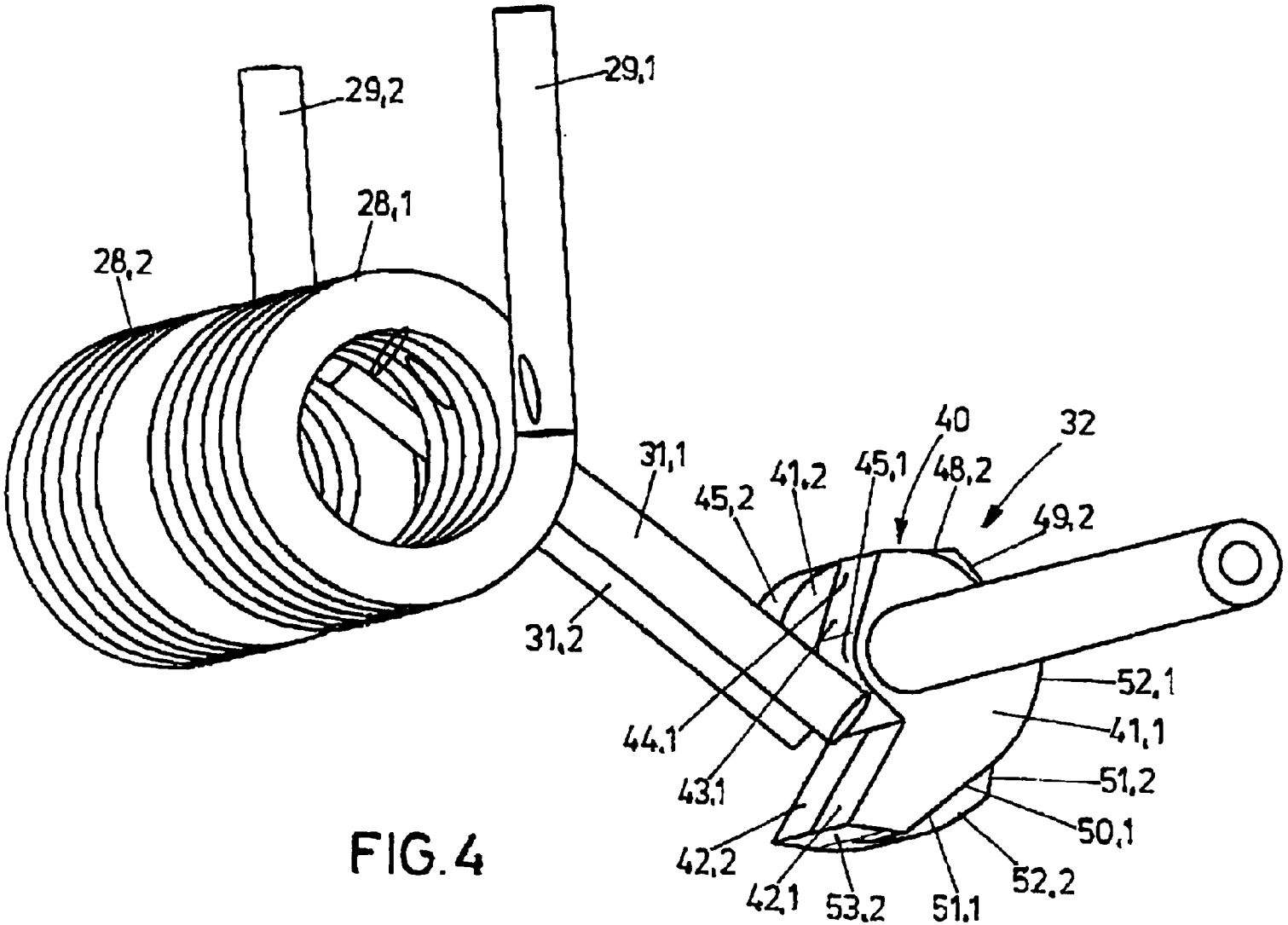
FIGS. 4 and 5 are perspective illustrations of details of the preloaded spring arrangement as used in the synchronizing mechanism according to FIGS. 1 to 3.
Figure 5:
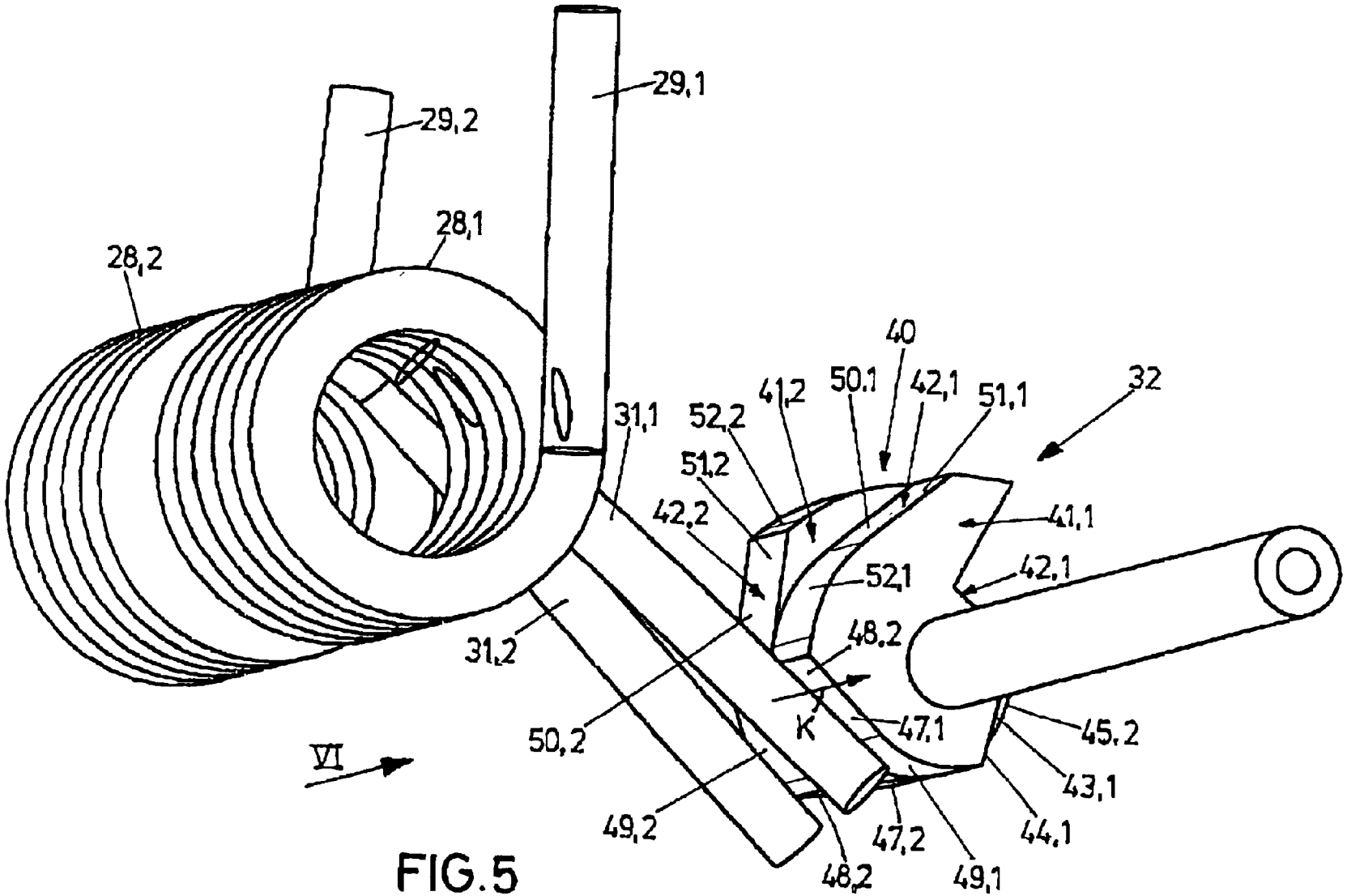
Figure 6:
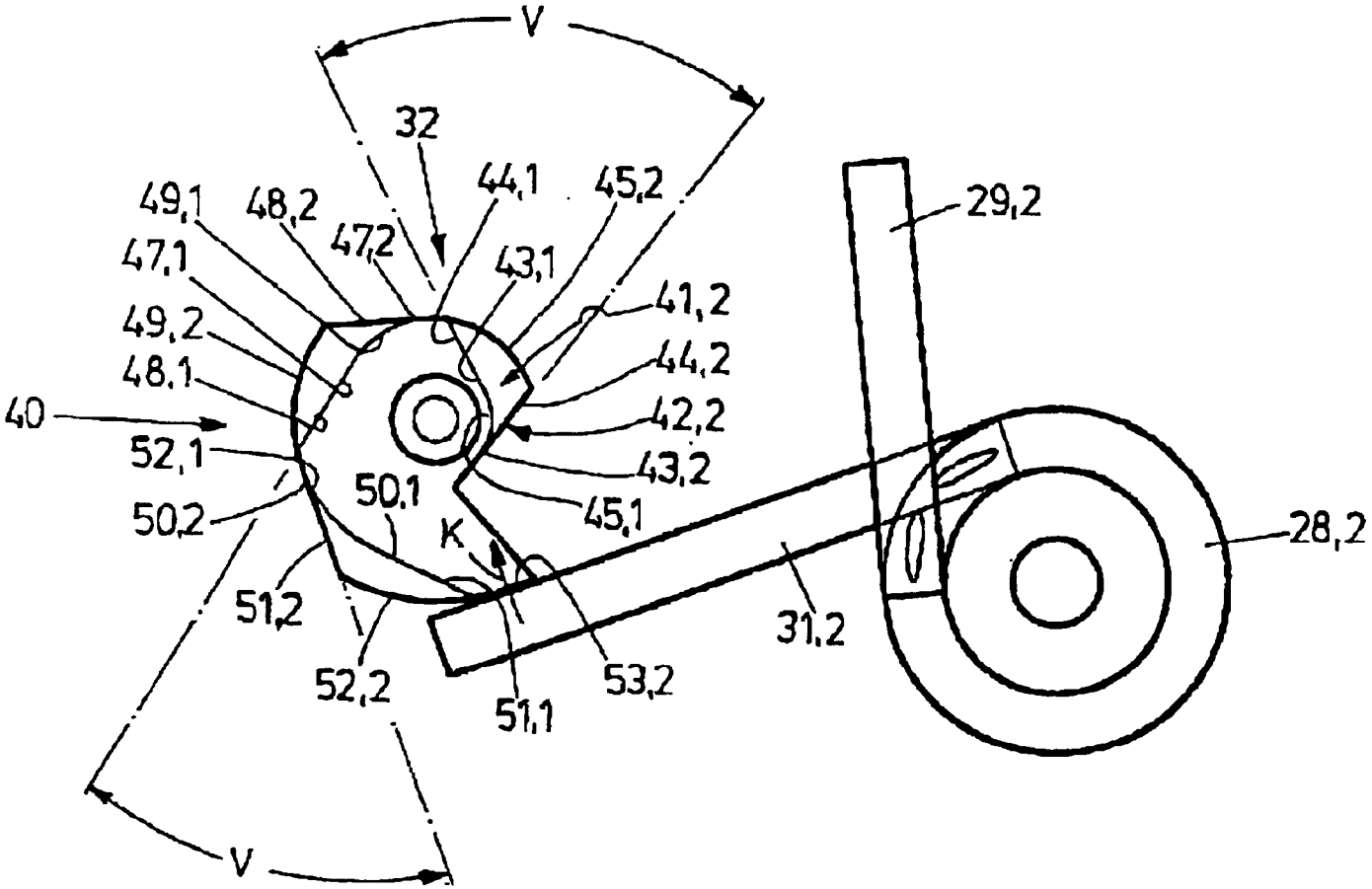
FIG. 6 is a lateral view of this spring arrangement seen from the direction of the arrow VI according to FIG. 5.

The configuration of the spring arrangement F and its adjusting mechanism 32 is going to be explained in conjunction with FIGS. 4 to 6. These drawings illustrate the two leg springs 28.1, 28.2, which are positioned coaxially on the pivot bearing axis 9, and their upward supporting legs 29.1, 29.2 and the two positioning legs 31.1, 31.2, which extend towards the adjusting mechanism 32. The projection 30 that serves as an abutment for the two supporting legs 29.1, 29.2 has been omitted.

The gist of the adjusting mechanism 32 is a single-piece double eccentric cam 40 comprised of two eccentric cams 41.1, 41.2 sitting axially side by side, with in each case one of the positioning legs 31.1, 31.2 of the respective leg spring 28.1, 28.2 supporting itself thereon.

The outward cam surfaces 42.1, 42.2 of the eccentric cams 41.1, 41.2 are divided into successive sections seen in the direction of rotation of the eccentric arrangement. The cam surface 42.2 of the eccentric cam 41.2, which is shown in solid lines in FIG. 6, starts with a first plane locking section 43.2 that is followed by a first cam control section 44.2 that ascends radially outwards as a coplanar, plane prolongation. The cam surface 42.2 is continued by a first holding section 45.2, along which the cam surface passes through an angle of rotation of approximately 60° concentrically of the axis of rotation, formed by the shaft 46, of the double eccentric cam 40. Sequential thereto as continuous, coplanar, plane surfaces are a second locking section 47.2, a second cam control section 48.2 of eccentrically outward ascent, a second holding section 49.2, which is concentric of the shaft 46, a third locking section 50.2, a third cam control section 51.2—both sections 50.2, 51.2 are coplanar—and a third concentric holding section 52.2.

The cam surface 42.1 of the other eccentric cam 41.1 is shown in FIG. 6 in a solid line that is thinner as compared to the cam surface 42.2, because it is hidden behind the eccentric cam 41.2 in the viewing direction of FIG. 6. As seen in this drawing, the cam surface 42.1 starts radially inwardly by a first holding section 45.1, which is again concentric of the shaft 46 and which is followed by a first locking section 43.1 and a first cam control section 44.2 in the form of a plane prolongation, which coplanar thereof. The cam control section 44.2 passes into a second holding section 49.1, which is continued by a second locking section 47.1 with a second cam control section 48.1 in the form of a coplanar prolongation. Sequential thereto is a third holding section 52.1 (again concentric of the shaft 46), which is continued by a third locking section 50.1 and a subsequent third cam control section 51.1. This cam control section 51.1 passes into a final short fourth locking section 53.1.

As seen especially in FIG. 6, the locking sections 43.2, 47.2, 50.2, the cam control sections 44.2, 48.2, 51.2 and the holding sections 45.2, 49.2 and 52.2 of the cam surface 42.2 and the locking sections 43.1, 47.1, 50.1, the cam control sections 44.1, 48.1, 51.1 and the holding sections 45.1, 49.1 and 52.1 of the first cam surface 42.1 are offset by an angle V in the range of 40° to 70°.

The design of the cam surfaces 42.1, 42.2 of the two eccentric cams 41.1, 41.2 gives rise to the following functional interaction between the two leg springs 28.1, 28.2:

By way of example, the initial position is the position of least deflection of the positioning legs 31.1, 31.2 seen in FIG. 4. In this position of rotation of the double eccentric cam 40, the positioning leg 31.2 bears against the first locking section 43.2, parallel thereto, of the cam surface 42.2. The load K it exercises on the eccentric cam 41.2 extends radially towards the axis of rotation of the eccentric (shaft 46) so that the positioning leg 31.2 does not exercise any load in terms of rotation of the shaft 46. Any rotation would only be occasioned by a turning moment on the shaft 46, whereby the position seen in FIG. 4 is quasi locked. The positioning leg 31.1 of the other leg spring 28.1 rests by point contact on the first holding section 45.1 of the cam surface 42.1, as a result of which no turning moment is exercised on the double eccentric cam 40.

For increased preload of the spring arrangement F, the shaft 46 is rotated counter-clockwise in FIGS. 4 and 5 (clockwise in FIG. 6) by the turning lever 33 for the first cam control section 44.2 of the cam surface 42.2 to deflect the positioning leg 31.2 more strongly, which augments the preload of the leg spring 28.2. Simultaneously, the positioning leg 31.1 applies neutrally on the first holding section 45.1 of the cam surface 42.1 so that only the preload of the leg spring 28.2 has to be countered for rotation. After an angle of rotation of for instance 66°, the positioning leg 31.2 of the cam surface 42.2 bears against the first holding section 45.2, whereas the positioning leg 31.1 rests on the first locking section 43.1. In this position of rotation, the eccentric cam is again locked into place, because none of the two positioning legs 31.1, 31.2 exerts a turning moment on the double eccentric cam 40. Any application of load by the positioning leg 31.1 on the first locking section 43.1 again takes place in a direction radial of the axis of rotation (shaft 46).

Upon further rotation, the first cam control section 44.1 of the cam surface 42.1 takes action so that the leg spring 28.1 is more strongly biased by the positioning leg 31.1 shifting correspondingly, while the positioning leg 31.2 applies neutrally on the first holding section 45.2 of the cam surface 42.2. Again, only the spring load of one leg spring 28.1 has to be countered during this further rotation.

This interaction between the actuation of a positioning leg by the cam control section of the corresponding cam surface and the simultaneous neutral application of the other positioning leg on the respective holding section continues beyond the intermediate position seen in FIG. 5, terminating in the final position of maximal deflection seen in FIG. 6. In FIG. 5, the positioning leg 31.1 of the first cam surface 42.1 bears for instance against the second locking section 47.1, while the positioning leg 31.2 of the other cam surface 42.1 rests on the second holding section 49.2. In the final position, both positioning legs 31.1, 31.2 are maximally deflected, with the positioning leg 31.1 resting on the end of the last holding section 52.1 and the positioning leg 31.2 on the fourth locking section 53.2. All in all, the seven locking sections 43.1, 43.2, 47.1, 47.2, 50.1, 50.2 and 53.2 define seven lock-in stages of spring load adjustment by simple manual operation of the shaft 46 via the turning lever 33.

What is claimed is:

1. A preloaded spring arrangement, in particular for spring loading office chair synchronizing mechanisms, comprising a pair of leg springs (28), which are coaxially positioned on a common axis (9), each having a supporting leg (29) and a positioning leg (31); and an adjusting unit (32) of a type of an eccentric, which the two positioning legs (31) are coupled with and by which they are displaceable for adjustment of a preload of the spring arrangement (F);

wherein, for stepwise locked spring load adjustment, the eccentric adjusting unit (32) comprises an eccentric arrangement having a pair of eccentric cams (40; 41) sitting axially side by side, cam surfaces (42) of which, related to a direction of rotation of the eccentric arrangement, successively comprise plane locking sections (43, 47, 50, 53), eccentric cam control sections (44, 48, 51) and holding sections (45, 49, 52) that are concentric of the axis of rotation of the eccentric arrangement; and the respective locking, cam control and holding sections (43, 47, 50, 53; 44, 48, 51; 45, 49, 52) of the two eccentric cams (40; 41) are offset in the direction of rotation of the eccentric arrangement.

2. A spring arrangement according to claim 1, wherein the cam control sections (44, 48, 51) are plane prolongations of the locking sections (43, 47, 50) which are coplanar thereof in an ascending direction of rotation of the eccentric arrangement.

3. A spring arrangement according to claim 1, wherein a load (K) exercised on the eccentric cam (40; 41) by the respective positioning leg (31) along the locking sections (43, 47, 50, 53) is directed radially towards the axis of rotation (9) of the eccentric arrangement.

4. A spring arrangement according to claim 1, wherein the offset angle (V) between respective successive sections of identical function (43, 47, 50, 53; 44, 48, 51; 45 49, 52) of the two eccentric cams (41, 41) ranges from 40° to 70°.

5. A spring arrangement according to claim 1, wherein the two eccentric cams (41) consist of a single piece (40).

6. A spring arrangement according to claim 1, wherein the two eccentric cams (40; 41) are mounted on manually operated shaft (46).

7. A seat synchronizing mechanism, comprising a base carrier (2), a seat carrier (6) and backrest carrier (7), which are adjustably mounted thereon, as well as a spring arrangement (F) according to claim 1 for actuation of the synchronizing mechanism counter to the rearward pivoting motion thereof.

* * * * *